US007308919B1

(12) United States Patent
Zavala

(10) Patent No.: US 7,308,919 B1
(45) Date of Patent: Dec. 18, 2007

(54) REFILL APPARATUS FOR MULTIPLE CONTAINERS

(76) Inventor: Sergio Zavala, 1300 W. Victoria Ave., Apt. #3, Montebello, CA (US) 90640-3309

( * ) Notice: Subject to any disclaimer, the term of this patent is extended or adjusted under 35 U.S.C. 154(b) by 0 days.

(21) Appl. No.: 11/247,648

(22) Filed: Oct. 11, 2005

Related U.S. Application Data

(60) Provisional application No. 60/619,726, filed on Oct. 18, 2004.

(51) Int. Cl.
*B65B 1/04* (2006.01)

(52) U.S. Cl. ..... 141/247; 141/198; 141/238; 141/243; 141/301

(58) Field of Classification Search ..... 141/192, 141/198, 234–247, 301, 363–366; 222/398, 222/523
See application file for complete search history.

(56) References Cited

U.S. PATENT DOCUMENTS

| | | | | |
|---|---|---|---|---|
| 518,306 | A * | 4/1894 | Clark | 141/198 |
| 531,388 | A | 12/1894 | Root | |
| 693,637 | A | 2/1902 | Brethour | |
| 924,344 | A * | 6/1909 | Goff | 141/121 |
| 979,819 | A | 12/1910 | Anderson | |
| 1,076,776 | A | 10/1913 | Matthews | |
| 1,411,284 | A | 4/1922 | Lebert | |
| 1,528,978 | A * | 3/1925 | McClellan | 141/129 |
| 2,030,084 | A * | 2/1936 | Winton | 141/242 |
| 2,168,380 | A * | 8/1939 | Winton | 141/250 |
| 2,872,953 | A * | 2/1959 | Duncan | 141/237 |
| 4,258,758 | A | 3/1981 | Nygards | 141/35 |
| 4,351,740 | A | 9/1982 | Joshi et al. | 252/90 |
| 5,381,839 | A * | 1/1995 | Dowd | 141/242 |
| 5,458,168 | A | 10/1995 | Lindgren | 141/199 |
| 5,515,892 | A | 5/1996 | Najafi et al. | 141/331 |
| 5,630,452 | A | 5/1997 | Schmid et al. | 141/199 |
| 6,085,806 | A * | 7/2000 | Davis et al. | 141/98 |
| 6,092,547 | A | 7/2000 | Komiya et al. | 137/192 |
| 6,719,021 | B1 | 4/2004 | Jwu | 141/131 |
| 6,820,660 | B1 | 11/2004 | Ludwig | 141/89 |
| 6,834,687 | B2 * | 12/2004 | Abzaletdinov | 141/86 |
| 2005/0145293 | A1 | 7/2005 | Jenkins et al. | 141/67 |

* cited by examiner

*Primary Examiner*—Timothy L. Maust
(74) *Attorney, Agent, or Firm*—Peter Ganjian

(57) ABSTRACT

A refill apparatus for multiple containers is provided, which comprises a single piece, integrally molded primary container for holding matter. The basin of the container is comprised of a bottom with a plurality of apertures that are arranged in rows and columns for allowing drainage of matter from the containment portion through the apertures. The plurality of apertures are integrally molded and coupled with an upper portion of a corresponding number of conduits that are commensurately arranged in rows and columns along an exterior of the bottom for allowing matter from the containment portion to flow and drain into a lower portion of the conduits, which are comprised of discharge tubes for facilitating simultaneous flow and depletion of matter out of the containment portion and into a secondary set of containers.

13 Claims, 3 Drawing Sheets

REFILL APPARATUS FOR MULTIPLE CONTAINERS

CROSS-REFERENCES TO RELATED APPLICATIONS

The present application claims priority from related U.S. Provisional Patent Application Ser. No. 60/619,726, filed Oct. 18, 2004, the entire disclosure of which is incorporated herein by this reference.

BACKGROUND OF THE INVENTION (1) Field of the Invention

This invention relates to a refill apparatus and, more particularly, to a multi-container refill apparatus.

(2) Description of Related Art

Conventional refill systems have been in use for a number of years, which enable most users to refill a secondary container such as a bottle with matter from a main or primary container. Reference is made to the exemplary U.S. Pat. Nos. 531,388; 693,637; 979,819; 1,076,776; 1,411,284; 4,258,758; 4,351,740; 5,458,168; 5,515,892; 5,630,452; 6,092,547; 6,719,021; and 6,820,660, and the U.S. Patent Application Publication 2005/0145293 A1. Regrettably, most conventional refill systems suffer from obvious disadvantages. With some, a user can refill single secondary containers only one at a time. With others, the refill systems are complex and mainly used on the factory floors of bottling companies using conveyor belts, and other complex electromechanical contraptions that allow simultaneous filling of plurality of bottles. Other refill systems use metal and are too heavy and bulky to be practical for everyday use in home or business. Still others use a single elongated conduit to feed a plurality of bottles lined sequentially, which makes the entire device impractical for use in small spaces, especially if a large number of bottles are to be filled simultaneously.

In light of the current state of the art and the drawbacks to current devices and methods mentioned above, a need exists for a refill apparatus that would allow for a plurality of containers to be refilled with matter without the use of complex electromechanical components, and that would be simple and practical for even home or business use.

BRIEF SUMMARY OF THE INVENTION

One aspect of the present invention provides a refill apparatus for multiple containers, comprising:

a single piece, integrally molded primary container;

the primary container having a containment portion for holding matter;

the containment portion is comprised of a bottom with a plurality of apertures that are arranged in rows and columns for allowing drainage of matter from the containment portion;

the plurality of apertures are integrally molded and coupled with a corresponding number of conduits that are commensurately arranged in rows and columns along an exterior of the bottom for facilitating flow and depletion of matter out from the containment portion.

An optional aspect of the present invention provides a refill apparatus for multiple containers wherein:

the bottom is further comprised of an interior surface with domed sections that are protruded and raised from the interior surface between the arranged rows and columns of the plurality of apertures for further facilitating a drainage and flow of matter from the containment portion.

Another optional aspect of the present invention provides a refill apparatus for multiple containers wherein: the primary container further includes a lid for covering the containment portion.

A further optional aspect of the present invention provides a refill apparatus for multiple containers wherein:

the primary container further includes a set of moveable handles coupled with lateral opposing walls of the containment portion for facilitating carrying the primary container.

Still a further optional aspect of the present invention provides a refill apparatus for multiple containers wherein:

the primary container is further comprised of removable stands that are detachably coupled with the containment portion with lengths longer than lengths of the conduits, thereby maintaining the conduits from contacting other surfaces.

Yet a further optional aspect of the present invention provides a refill apparatus for multiple containers wherein:

the primary container is further comprised of removable stands that are detachably coupled with the containment portion with lengths longer than lengths of a set of secondary containers.

Another optional aspect of the present invention provides a refill apparatus for multiple containers wherein:

the primary container further includes a filter comprised of a filtering medium, with the filter coupled with lateral walls of the containment portion.

Yet another optional aspect of the present invention provides a refill apparatus for multiple containers wherein:

the filtering medium is a screen with holes.

A further optional aspect of the present invention provides a refill apparatus for multiple containers wherein:

the filtering medium is comprised of porous material for adsorbing and filtering out undesirable matter.

Yet a further optional aspect of the present invention provides a refill apparatus for multiple containers wherein:

the primary container further includes a filter comprised of a filtering medium, with the filter positioned on the bottom interior surface of the containment portion.

Another optional aspect of the present invention provides a refill apparatus for multiple containers wherein:

the conduits are comprised of an upper portion having telescopically collapsible and extendable modules.

Still another optional aspect of the present invention provides a refill apparatus for multiple containers wherein:

the conduits are comprised of a lower portion discharge tubes including a shut-off valve for controllable flow of matter out from the containment portion.

Yet another optional aspect of the present invention provides a refill apparatus for multiple containers wherein:

the conduits are comprised of funnels.

A further optional aspect of the present invention provides a refill apparatus for multiple containers wherein:

the bottom is further comprised of an interior surface that is flat.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding parts throughout.

DETAILED DESCRIPTION OF THE INVENTION

Figure 1:
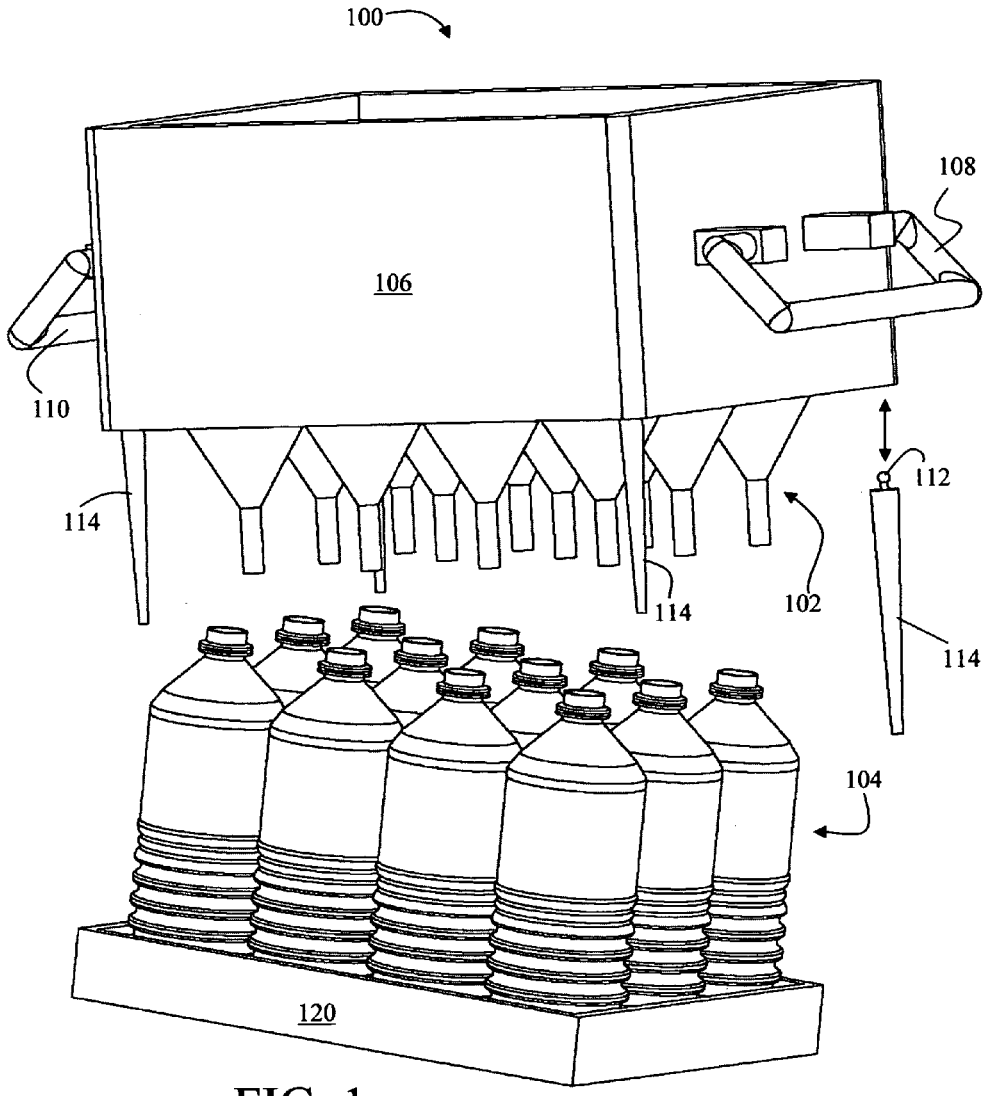
FIG. 1 is an exemplary perspective illustration for a refill apparatus in accordance with the present invention.

Conventional refill systems for simultaneously refilling multiple containers are complex, bulky, heavy, mainly used on factory production lines, and are not practical for everyday use in homes or businesses. The present invention provides a multiple container refill apparatus that is simple and economical to manufacture, is portable, lightweight, and is easy and practical for home, business (such as restaurants), or outdoor usage. As illustrated in the exemplary FIG. 1, the present invention is comprised of a single piece, integrally molded primary container 100 for holding matter, with a bottom having a plurality of apertures that are arranged in rows and columns for allowing the matter (such as liquid, granulated solids, or others) therein to drain. The plurality of apertures are integrally molded and coupled with an upper portion of a corresponding number of conduits 102 that are commensurately arranged in rows and columns along an exterior of the bottom of the primary container 100. Preferably, the conduits are configured as a single, unitary solid piece, and are integrally molded with the primary container 100 to form a single piece unit.

The primary container 100 of the present invention (including its conduits 102) is made to simultaneously refill a set of secondary containers 104 that are arranged in a corresponding set of rows and columns inside an optional rack 120. The nozzles of the conduits 102 are placed inside the necks of the secondary containers 104 through their respective opening for simultaneous discharge of matter from a containment portion or basin 106 into the secondary containers 104. In other words, the conduits 102 allow matter from the apertures of the primary container 100 to flow and drain into a corresponding set of secondary containers 104, thereby simultaneously refilling the secondary containers 104. Non-limiting examples of secondary containers may include water bottles, containers that are used for condiments (such as a mustered bottle) or any other type of a container such as salt or pepper containers used in homes or restaurants, etc. Accordingly, the matter or substance may have a solid form (e.g., powdered or chunky material), a liquid form (e.g., water, honey, syrup, oil, etc.), or a hybrid combination of solid and liquid mixture that is depleted, removed or drained easily. Therefore, for example, using the present invention in a restaurant setting, a single user may simultaneously refill multiple syrup, salt, or pepper containers, rather than one container at a time, providing a more efficient operation for the employees and the business.

As further illustrated in the exemplary FIG. 1, the present invention provides a refill apparatus for multiple containers that is comprised of a single piece, integrally molded primary container 100, having a basin or containment portion 106 for holding matter therein. Although the containment portion 106 is illustrated as an exemplary rectangular box configuration, it should be readily apparent to those skilled in the art that a plethora of other configurations are also possible, non-limiting examples of which may include rounded or bowl-like forms. The size of the containment portion 106 may be varied in its dimensions (e.g., depth, length, width, diameter, etc.) to vary its capacity or volume for retaining matter.

In one alternative embodiment, the primary container 100 further includes a set of moveable handles 108, and 110 coupled with lateral opposing walls of the containment portion 106 for facilitating usage and transport of the primary container 100. In yet another alternative embodiment, the containment portion 106 includes a set of removable legs or stands 114 that are generally detachably coupled with the bottom section thereof. The removable stands or legs 114 may be detachably coupled with the bottom exterior 302 (illustrated in FIG. 3) of the containment portion 106 by a plethora of methods, a non-limiting example of which may include the use of complementary or reciprocal male and or female couplers, with the female coupler attached to one (e.g., the containment portion 106) and the male coupler 112 to the other (e.g., the top of the stand 114). The exemplary male coupler 112 is illustrated as a snap-on device, with the female coupler being a joint for receiving the male coupler 112. It should be readily apparent to those skilled in the art that other coupler configurations are also possible, non-limiting examples of which may include the use of screws on top of the stand 114 and a corresponding female coupler (e.g., a threaded aperture) at the bottom section of the containment portion 106, where the stand 114 is simply screwed therein. The removable stands 114 detachably coupled with the containment portion 106 enable storage, packing, and cost effective shipping and display of the primary container 100 when the stands 114 are detached. In general, the stands 114 have lengths longer than the lengths of the conduits 102, thereby maintaining a lower portion of the conduits 102 from contacting with other surfaces in order to maintain sanitary conditions therefor.

Figure 2:
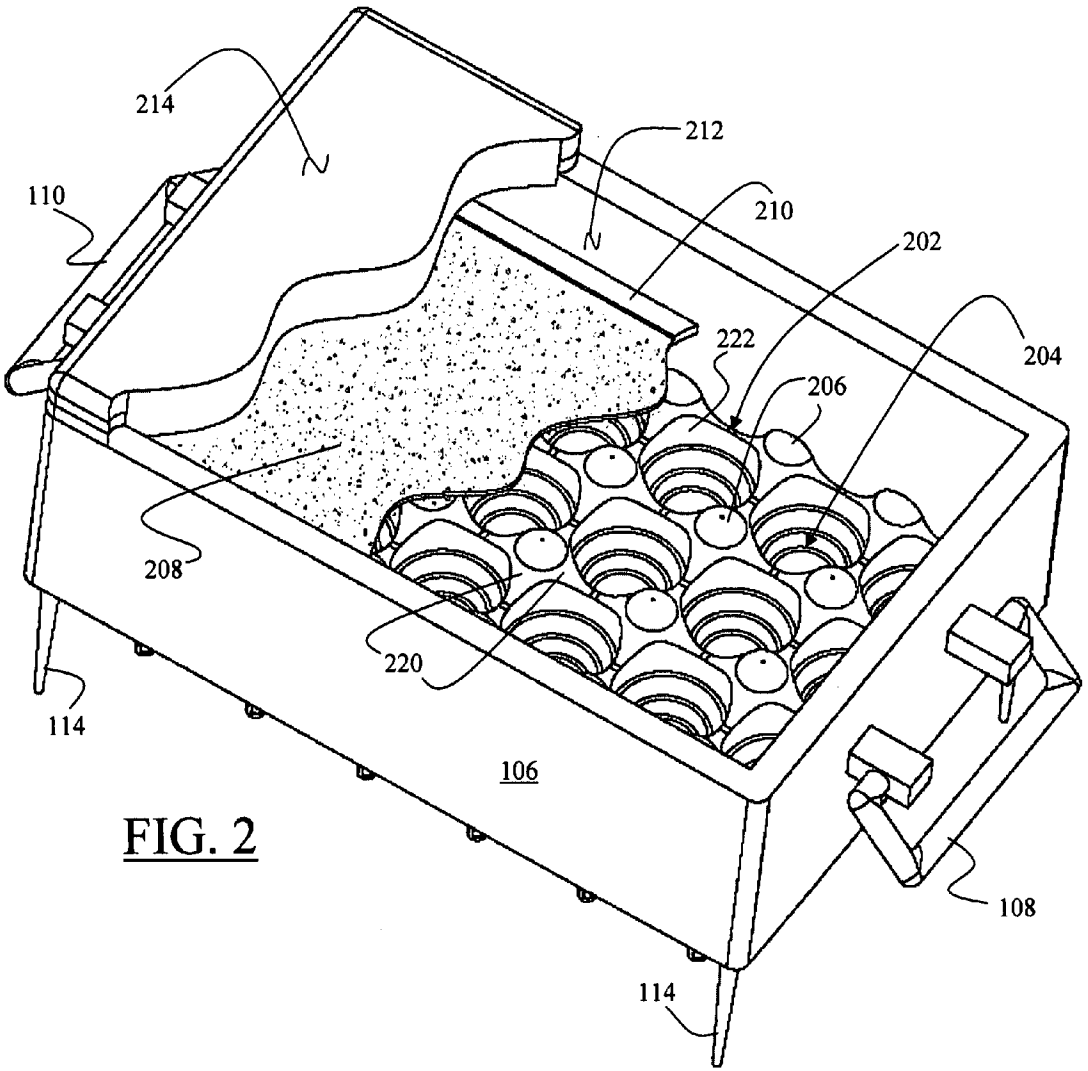
FIG. 2 is an exemplary top-view perspective illustration for a refill apparatus in accordance with the present invention.

As best illustrated in the exemplary FIG. 2, the basin or containment portion 106 is comprised of an interior bottom surface 202 with a plurality of apertures 204 that are arranged in rows and columns for allowing drainage of matter from the containment portion 106 through the apertures 204 and into the secondary containers 104 via the conduits 102. In one alternative embodiment, the interior bottom surface 202 is comprised of conical projections (or domed sections) 206 that are protruded and raised from the interior bottom surface 202 between the arranged rows and columns of the plurality of apertures 204 for further facilitating a drainage and flow of matter. The radial surfaces 220 of the conical projections 206 are beveled or sloped radially downward, towards the circumferential edges 222 of the apertures 204. The conical projections 206 with their oblique radial surfaces 220, including the circumferential edges 222 of the apertures 204 form a smooth, uniform, and contiguous surface that are also integral with the interior bottom surface 202 to form a single piece unit. Alternatively, it should be readily apparent to those skilled in the art that other configurations for the interior bottom surface 202 are also possible, a non-limiting example of which may include an interior bottom surface 202 that is flat, without any domed sections 206.

As is further illustrated in FIG. 2, another alternative embodiment of the refill apparatus of the present invention for multiple containers is comprised of a filter or a filter pad 208 having a filtering medium, with the filter 208 coupled with the interior lateral walls 212 of the containment portion 106. Non-limiting examples of the filtering medium that can be used with the present invention may include a simple screen 502 (illustrated in FIG. 5) with holes that screens out or filters large elements from matter (such as large chunks of material). Other non-limiting examples for a filtering medium may include the use of porous material for adsorbing and filtering out undesirable matter. In particular, the porous material used may comprise of well-known charcoal filters that absorb impurities as the matter (such as water) passes through the filter. This form of well-known filter is simple to install, relatively economical, and filters out the most deadly of contaminants, including Cryptosporidium and Giardia. There are a number of well-known variations to charcoal filters, and countless well-known special manufacturing techniques for producing them, which result in highly porous charcoals that have large surface areas, and which can be used to adsorb undesired substances from gases or liquids. As further illustrated in FIG. 2 in yet another alternative embodiment, the filter 208 is rested on filter supports 210, which are positioned along the interior vertical sections (or walls) 212 of the containment position 106. The filter 208 may be also positioned or placed on the bottom interior surface 202, on top of the apertures 204. The primary container 100 may further include a lid 214 for covering the interior chamber of the containment portion 106 for protection against dirt and debris.

Figures 3, 4, 5:
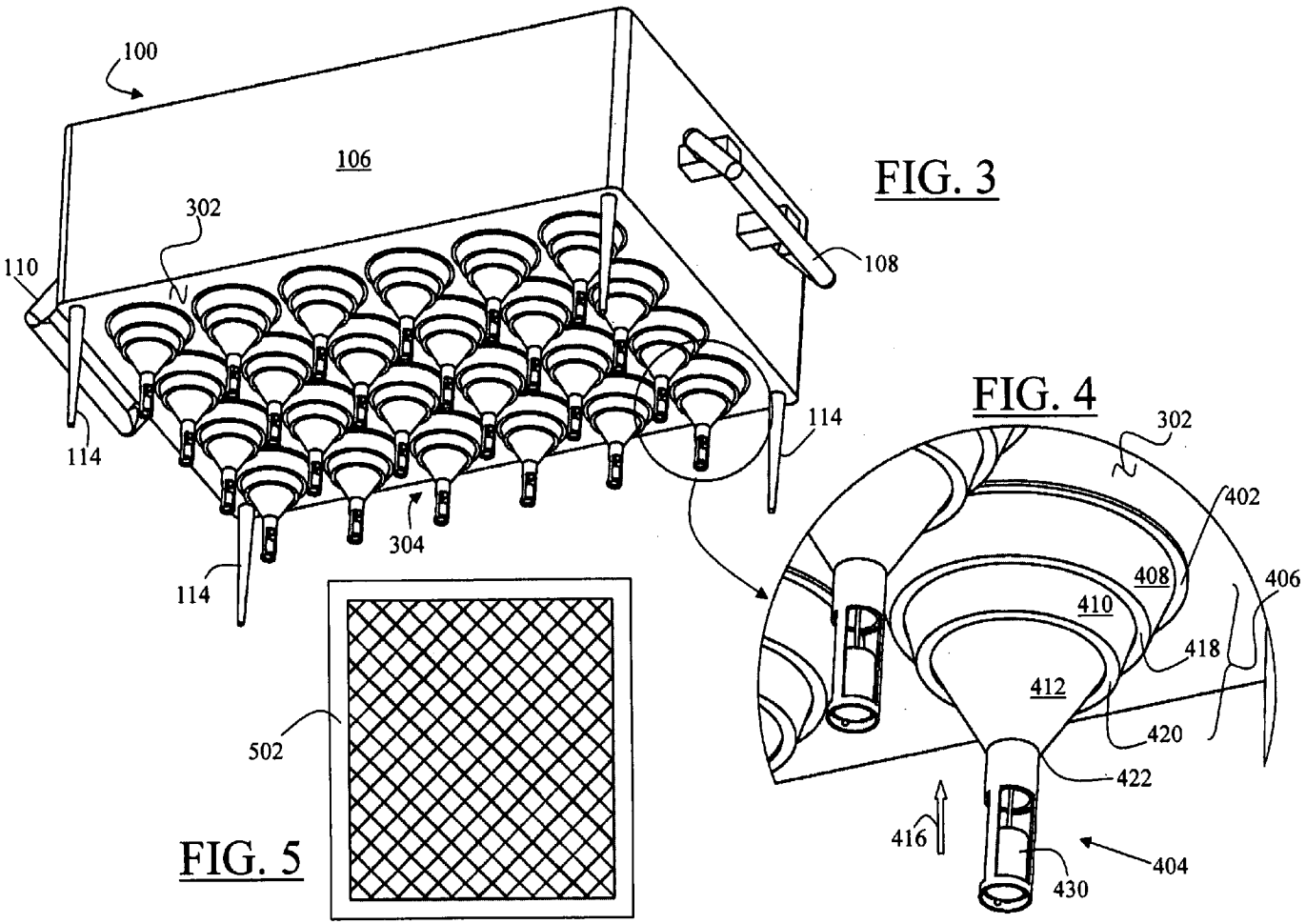
FIG. 3 is an exemplary bottom-view perspective illustration for a refill apparatus in accordance with the present invention.
FIG. 4 is an exemplary enlarged view for conduits in accordance with an alternative embodiment of the present invention.
FIG. 5 is an exemplary illustration of one embodiment of a filter used with a refill apparatus in accordance with the present invention.

FIG. 3 is an exemplary perspective illustration of an exterior bottom surface 302 of the primary container 100, illustrating an exemplary alternative embodiment for the conduits 102 that are illustrated in FIG. 1. The plurality of apertures 204 (illustrated in FIG. 2) are integrally molded and coupled with an upper circumferential edge 402 (illustrated in FIG. 4) of a corresponding number of conduits 304 that are commensurately arranged in rows and columns along the bottom exterior portion 302 for allowing matter from the containment portion 106 to flow and drain into a lower portion of the conduits 304, which are comprised of discharge tubes 404 (illustrated in FIG. 4) for facilitating flow and depletion of matter out of the containment portion 106.

As best illustrated in FIG. 4, the conduits 304 may be comprised of telescopically collapsible and extendable upper conduit portion 406, which reduces packing and storing space of the primary container 100 when the upper conduit portion 406 is retracted, resulting in cost-effective storage, shipping, and display. The conduits 102 are also comprised of a lower conduit portion, which are the discharge tubes 404 (described in detail below). The upper conduit portion 406 is comprised of several proximately cone shaped modules 408, 410, and 412 configured to telescopically receive one another. Although three cone type modules are illustrated, it should be readily apparent to those skilled in the art that any size or number of modules may be used, depending on the length of the conduit desired when the modules are fully extended.

The first module 408 telescopically receives the second module 410, and the third module 412. The dimension of the circumference or the perimeter size of the upper circumferential edge 402 of the first module 408 is made to commensurately correspond with the size of the apertures 204 at the exterior bottom surface 302 of the containment portion 106. The intermediate body portion of first module 408 slide-ably receives the second module 410 in a telescopic fashion in a direction illustratively indicated by arrow 416. In this regard, intermediate body portion of the first module 408 preferably assumes a conical shape such that the upper circumferential edge 402 has a larger diameter than a distal end 418. Further, the distal end 418 of first module 408 has a diameter slightly smaller than that of the proximate end (not shown) of second module 410. Thus, the second module 410 does not disengage from the first module 408 during use when the conduit 304 is fully extended.

The second module 410 and the third module 412 are constructed similar to the first module 408, but with reduced diameters. Thus, the second module 410 and the third module 412 are also preferably conical in shape. The intermediate body portion of the second module 410 slide-ably receives the third module 412. However, distal end 420 of the second module 410 has a diameter slightly smaller than that of the proximal end (not shown) of the third module 412 such that the third module 412 does not entirely disengage from the second module 410 during use when conduit 304 is fully extended. The distal end 422 of the third module 412 is integral with the discharge tube 404.

With the above described configuration, the upper conduit portion 406 can be maintained in either an extended or retracted positions. In an extended position, the second module 410 extends outwardly from first module 408 such that proximal end of the second module 410 is approximately adjacent the distal end 418 of the first module 408. In this regard, because the proximal end of the second module 410 has a diameter slightly greater than that of the distal end 418 of the first module 408, the second module 410 is frictionally maintained in the extended position. The third module 412 is similarly maintained in the extended position relative to the second module 410. Well-known stops or locking mechanism may be employed to maintain the modules in the extended position, in particular, when the containment portion is filled to capacity and becomes heavy due to the weight of the matter contained therein, which may force the telescopic collapse of the modules. As an alternative to the stops or the locking mechanisms for the modules, the stands or legs 114 of the primary container 100 may be made to have lengths longer than the lengths of the conduits and the secondary containers 104. The longer set of stands 114 would enable the primary container 100 to stand on its own rather than be placed on top of the containers 104 where the entire weight of the primary container 100 (including matter therein) would be carried by the modules. Therefore, a longer set of stands 114 would allow the entire weight of the primary container 100 and any matter therein to be carried by the stands 114, and not be place on the telescopic conduits that may force their collapse. The longer stands 114 may use the exemplary snap-on mechanism 112, which would enable the stands 114 to be removed for storage, and re-attached for use.

Referring to FIG. 4, in the retracted position, the third module 412 and the second module 410 slide within each other and within the first module 408. The upper conduit portion 406 can be maneuvered from the retracted position to the extended position by simply pulling the discharge tube 404 in the direction away from the exterior bottom surface 302 (opposite direction of the illustrated arrow 416). The collapsible upper conduit portion 406 retracted and hidden inside the exterior bottom surface 302 provides extreme compactness for packing, storing, and shipping. In addition, stores may display the primary container 100 on shelves or manufacturers may ship the primary container 100 inside compact boxes, with the removable stands 114 detached. The sizes of the packing boxes for the primary container 100 or the dimensions of the shelves displaying or storing the primary container 100 can also be reduced due to the above storable features for the conduits 304 and the stands 114. In addition, the reduction in size of the overall alternative refill systems due to the storable features does not necessarily effect manufacturing costs, and in fact, may lower costs in packing, storing, and shipping the primary container 100.

As further illustrated in FIG. 4, the discharge tubes 404 of the conduits 304 may comprise of simple solid nozzles (e.g., similar to conduits 102 illustrated in FIG. 1) or alternatively, configured to accommodate and include a well-known shut-off valve 430 for controlling or stopping the flow of matter out from the basin or containment portion 106, and into the secondary containers 104. The shut-off valve 430 would enable an even level distribution of matter in all secondary containers 104, thereby avoiding possible overflow of matter from any one of the secondary containers 104. The shut-off value 430 and the commensurate configuration of the discharge tubes 404 to accommodate the shut-off valve 430 are well-known, and taught in the U.S. Pat. No. 6,719,021 to Jwu and U.S. Pat. No. 5,630,452 to Schmid et al. The entire disclosures of the U.S. Pat. No. 6,719,021 to Jwu and U.S. Pat. No. 5,630,452 to Schmid et al. are incorporated herein by this reference, and the information incorporated herein is as much a part of this application as filed as if the entire text and drawings of the U.S. Pat. No. 6,719,021 to Jwu and U.S. Pat. No. 5,630,452 to Schmid et al. were repeated in this application, and should be treated as part of the text and drawings of this application as filed.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art. For example, the number and sizes of apertures and the corresponding conduits may vary to accommodate refilling of a commensurately varying sizes or numbers of secondary containers. Although the stands or legs 114 are illustrated as an exemplary cylindrical configuration, it should be readily apparent to those skilled in the art that other configurations are also possible, non-limiting examples of which may include the use of other forms, including rectangular cubes. Other non-limiting examples of a coupler for the removable stands 114 to detachably couple with the containment portion may include the use of hinges or interlocking mechanisms to enable the stands 114 to be bent, closed, or removed for storage, packing, and cost effective shipping and display of the primary container 100. The hinges or interlocking mechanisms may be comprised of any well-known interlocking systems that also provide a pivoting action for the stands 114 so that they can be bent longitudinally in one or more places for storing the primary container 100. The stands 114 may also be configured so that they are telescopically extendable for use, and telescopically retrieved or collapsed for storage. The primary container 100 may comprised of any suitable well-known material appropriate for its intended use and environment, non-limiting examples of which may include plastic or other recyclable materials, including aluminum. Such variations and alternate embodiments are contemplated, and can be made without departing from the spirit and scope of the invention.

What is claimed is:

1. A refill apparatus for multiple containers, comprising:
a single piece, integrally molded primary container;
the primary container having a containment portion for holding matter;
the containment portion is comprised of a bottom with a plurality of apertures that are arranged in rows and columns for allowing drainage of matter from the containment portion;
the plurality of apertures are integrally molded and coupled with a corresponding number of conduits that are commensurately arranged in rows and columns along an exterior of the bottom for facilitating flow and depletion of matter out from the containment portion, with the conduits comprised of an upper portion having telescopically collapsible and extendable modules.

2. The refill apparatus for multiple containers as set forth in claim 1, wherein:
the bottom is further comprised of an interior surface with domed sections that are protruded and raised from the interior surface between the arranged rows and columns of the plurality of apertures for further facilitating a drainage and flow of matter from the containment portion.

3. The refill apparatus for multiple containers as set forth in claim 1, wherein:
the primary container further includes a lid for covering the containment portion.

4. The refill apparatus for multiple containers as set forth in claim 1, wherein:
the primary container further includes a set of moveable handles coupled with lateral opposing walls of the containment portion for facilitating carrying the primary container.

5. The refill apparatus for multiple containers as set forth in claim 1, wherein:
the primary container is further comprised of removable stands that are detachably coupled with the containment portion with lengths longer than lengths of the conduits, thereby maintaining the conduits from contacting other surfaces.

6. The refill apparatus for multiple containers as set forth in claim 1, wherein:
the primary container is further comprised of removable stands that are detachably coupled with the containment portion with lengths longer than lengths of a set of secondary containers.

7. The refill apparatus for multiple containers as set forth in claim 1, wherein:
the primary container further includes a filter comprised of a filtering medium, with the filter coupled with lateral walls of the containment portion.

8. The refill apparatus for multiple containers as set forth in claim 7, wherein:
the filtering medium is a screen with holes.

9. The refill apparatus for multiple containers as set forth in claim 7, wherein:
the filtering medium is comprised of porous material for adsorbing and filtering out undesirable matter.

10. The refill apparatus for multiple containers as set forth in claim 1, wherein:

the primary container further includes a filter comprised of a filtering medium, with the filter positioned on the bottom interior surface of the containment portion.

11. The refill apparatus for multiple containers as set forth in claim 1, wherein:

the conduits are comprised of a lower portion discharge tubes including a shut-off valve for controllable flow of matter out from the containment portion.

12. The refill apparatus for multiple containers as set forth in claim 1, wherein:

the conduits are comprised of funnels.

13. The refill apparatus for multiple containers as set forth in claim 1, wherein:

the bottom is further comprised of an interior surface that is flat.

* * * * *